US005194218A

United States Patent [19]

Rothman

[11] Patent Number: 5,194,218

[45] Date of Patent: Mar. 16, 1993

[54] TUNGSTEN-YTTRIA CARBIDE COATING FOR CONVEYING COPPER

[75] Inventor: Albert J. Rothman, Livermore, Calif.

[73] Assignee: The United States of America as represented by the United States Department of Energy, Washington, D.C.

[21] Appl. No.: 241,234

[22] Filed: Aug. 18, 1988

[51] Int. Cl.[5] ..... B22F 7/00

[52] U.S. Cl. ..... 419/1; 419/9

[58] Field of Search ..... 419/1, 8, 9; 428/552

[56] References Cited

U.S. PATENT DOCUMENTS 4,366,910 12/1982 Buhrer ..... 220/2.1 R
4,678,718 7/1987 Wang ..... 419/4

OTHER PUBLICATIONS

Cowan, R. E., et al., "Mechanism of Tungsten Adherence to Bodies Containing Yttria", Report No. (A-670-4-MS, Los Almos Scientific Laboratory, Los Alamos, New Mexico (Mar. 1977).

Cowan, et al., "Tungsten Metalizing Alumina-Yttria Ceramics", Report No. LA-6705-MS Los Alamos Scientific Laboratory (Mar. 1977).

*Primary Examiner*—Peter A. Nelson

*Attorney, Agent, or Firm*—Miguel A. Valdes; Roger S. Gaither; William R. Moser

[57] ABSTRACT

A method is provided for providing a carbided-tungsten-yttria coating on the interior surface of a copper vapor laser. The surface serves as a wick for the condensation of liquid copper to return the condensate to the interior of the laser for revolatilization.

15 Claims, No Drawings

TUNGSTEN-YTTRIA CARBIDE COATING FOR CONVEYING COPPER

The United States government has rights in this invention pursuant to Contract No. W705-48 between the United States Department of Energy and the University of California for the operation of Lawrence Livermore National Laboratory.

FIELD OF THE INVENTION

The present invention is directed to a method for conveying molten copper on the interior of a copper vapor laser tube by providing the interior of the tube with a carbided tungsten-yttria surface.

BACKGROUND OF THE INVENTION

In the operation of a copper vapor laser, the copper may become unavailable for lasing by condensation at the cool ends of the laser tube. Various wicks may be inserted near the ends of the laser tube to serve both as condensers for the copper vapor and as conduits to allow flow by capillary action of the liquid copper back into the hot zone of the laser where it is revaporized. However, the wicks may diminish the useful interior bore of the laser, therefore it would be desirable to provide a wicking surface which is thin and coated onto the inner surface of the laser bore.

One problem is that the laser tube, commonly made of alumina or other ceramic, does not readily receive coatings wettable by liquid copper and which would withstand the internal temperatures of the laser for an extended period of time without refinishing.

The present invention is directed to a method for providing coatings for the interior of a copper vapor laser tube which strongly adhere to the alumina and form uniform surfaces which are wettable by liquid copper.

SUMMARY OF THE INVENTION

It is an object of the present invention to provide a method for alleviating the loss of copper from the interior of a copper vapor laser by providing a thin coating which serves as a wick for the condensed liquid copper.

It is a further object of the present invention to provide a method for preparing a tungsten-yttria surface on alumina which is able to withstand interior temperatures of a copper vapor laser.

Briefly, the present invention provides a method for forming a copper-wettable carbided tungsten-yttria surface on the interior of a copper vapor laser tube, comprising the steps of either coating the alumina surface with a suspension of tungsten and yttria, or coating an alumina-yttria surface with tungsten; then drying the coating, sintering the dried coating at a temperature in the range of about 1500–1700° C. in the presence of moist hydrogen or inert gas; and carbiding the sintered surface by heating while in contact with carbon at a temperature greater than about 1400° C.

Additional objects, advantages and novel features of the present invention will be set forth in part in the following description and in part will become apparent to those skilled in the art upon examination, or may be learned upon practice of the invention. The objects and the advantages of the invention may be realized and obtained by means of the instrumentalities and combinations particularly pointed out in the appended claims.

DETAILED DESCRIPTION OF THE PREFERRED EMBODIMENTS

It has been unexpectedly found that the forming of a durable, metal-wettable surface over alumina which is substantially impervious to the environment of the interior of an operating metal vapor laser requires the method according to the present invention. In particular, it has been found that the alumina surface, since the body of a laser is typically made of alumina, should be initially coated with a material comprising tungsten and yttria in the form of a suspension, the suspension containing tungsten powder and yttria powder wherein the yttria is less than about 10% by weight of the total weight of the tungsten. Usually, and most preferably, yttria will be about 2% by weight of the total weight of the tungsten. Both the tungsten and yttria will be in powdered form so that they may be suspended in a liquid carrier. Preferred mesh size for the tungsten is about −200 mesh and for the yttria −100 mesh. The mesh size of the powder, however, is not believed to be critical. The suspension will be formed primarily with water with a small amount of thickening, suspending and/or wetting agents, such as glycerine, or a conventional wetting agent. In most instances less than 1 ml of glycerine and less than 1 gram of wetting agent will be used per 100 grams of tungsten powder, but it should be realized that these amounts are not critical since the only requirement is that the tungsten and yttria remain in suspension. The suspension preferably will be of a viscosity and texture sufficient to allow application with a brush. Usually the texture and viscosity will suffice if about 20–25 mls of water is used per hundred grams of tungsten powder.

The suspension will be applied over the alumina surface to be coated, dried and set, usually in air, followed by treating at a temperature of about 150°–200° C. from 4 to 8 hours under a slight vacuum (usually about 1 to 3 inches of mercury, absolute) to volatilize and/or oxidize the remaining volatiles and trace organic impurities.

Various atmospheric conditions may be used for the sintering of the dried tungsten-yttria coating, but the sintering most preferably should take place at a temperature greater than about 1500° C., preferably about 1500°–1600° C. under vacuum. The vacuum should be in the range of about $10^{-4}$ to $10^{-5}$ torr. Usually sintering will be complete in less than four hours.

Alternatively, the coatings may be sintered at around 1500°–1600° C. in wet hydrogen (30° C. dew point, for example) rather than in a vacuum.

While not intending to limit the invention to a particular theory, it is believed that the tungsten-yttria coating forms a strong bond with the alumina substrate. The sintered tungsten-yttria coating then forms a smooth surface which is receptive to carbiding. The tungsten-yttria surface is placed in contact with graphite foil, powder or other form of graphite, and heated at a temperature above about 1400° C., preferably from about 1550°–1650° C. The carbiding is preferably conducted in the presence of hydrogen, preferably diluted by an inert gas to 5–6% to maintain a non-explosive mixture. Carbiding will usually be complete in about 2–3 hours. In order to maintain sufficient intimate contact between the graphite and the tungsten-yttria surface, the laser tube may be packed with graphite powder, then an atmosphere of hydrogen diluted with inert gas may be flowed through the tube. Inert gases such as argon, neon, etc. may be utilized as the diluent gas.

In another embodiment, the housing of the metal vapor laser may be fabricated of alumina-yttria, instead of alumina alone. In this instance, the housing will comprise mostly alumina, with a minor amount, usually less than 10% by weight, of yttria, so that there is sufficient yttria present at the surface to bind the tungsten coating to the housing without detrimentally affecting the desirable structural properties of the alumina. Since the yttria will thus be incorporated in the housing, then the applied coating need only provide tungsten. The subsequent drying, sintering and carbiding steps may be then performed under the conditions described above.

The above-described conditions result in a surface which is wetted by the molten metal in a metal vapor laser, in particular, by copper in a copper vapor laser, so that as the metal vapor is condensed at the cooler ends of the laser, the wetted surface serves to conduct the condensed metal back to the interior of the laser where it is revaporized, thus conserving the metal vapor.

Having described the above preferred embodiments of the present invention, the following example is presented by way of illustration, but is not intended to limit the invention in any way.

EXAMPLE

Several different paint compositions were tested for their ability, after carbiding, to wet copper. The coatings of the samples were painted over alumina and fired as follows. Using an artist's paintbrush, the paint was applied to the concave surface of a one-inch-square piece of a sectioned alumina tube. The coating was air dried, then baked at 150°-200° overnight under a vacuum of about 1-3 inches of mercury (absolute). Then the coated materials were fired in a vacuum or in a moist hydrogen atmosphere. When fired in wet hydrogen (30° C. dew point) a temperature of 1500°-1600° C. was used for about 2 hours. Some runs were fired at 1600° for 4 hours. Other firings were done in a vacuum of about $10^{-4}$ to $10^{-5}$ torr at 1500°-1600° C. for 2-3 hours.

The paints used were as follows. Paint formulation A1 was made by mixing the following substances and ball-milling from 4-6 hours: pure tungsten powder (−200 mesh), 100 gms; pure yttria powder (−100 mesh), 2 gms; deionized water, 22 ml; glycerine, 0.6 ml; Goodrite K732 (wetting agent, B. F. Goodrich, Cleveland, Ohio), 0.5 gms. Paint A2 was obtained from Coors, Golden, Colo., containing the same general tungsten and yttria composition as paint A1, but in a different vehicle. Paint sample A3 was a paint using the same formulation as paint A1, except that tungsten carbide powder was used instead of tungsten powder.

Samples were carbided under several test conditions. One-inch square metal coated alumina pieces were placed in a small tubular furnace along with graphite foil covering about one-half the coated area and heated to 1300° in a stream of argon plus 6% hydrogen for 2-3 hours then allowed to cool. The pieces were then tested for wetting with carbon as described below. In some instances the carbiding temperature was raised to 1400° C. When the carbiding and the wetting tests were conducted in different experiments at different temperatures. The different experiments at different temperatures are indicated at Table 1, otherwise carbiding and contact with copper were done simultaneously at the single temperature indicated in the table.

For the samples in which the carbiding and copper wetting were done simultaneously, graphite foil was used covering one-half the sample and a one-quarter to one-half inch length of one-eighth inch diameter copper wire was placed on the sample. The gas mixture at the indicated temperatures was then utilized.

Wetting for all tests was determined by the degree of spreading of the copper on the cooled sample where the coating quality as to adherence and wetting is on the scale of zero to 5, 5 representing complete wetting and adherence and an almost flat copper coat and 0 representing no wetting and/or loss of the coating. The numbers were subjectively assigned. The results are given below in Table 1. As shown in this table, the samples showed excellent copper wetting properties.

TABLE 1

| | Firing Conditions | | | | |
|---|---|---|---|---|---|
| Coating | Atm. | Temp. Deg. C. | Carbiding Temp. | Wetting Temp. | Wetting |
| A1 | Vac | 1500 | 1500 | | 5 |
| | $H_2$ | 1600 | 1500 | | 5 |
| | Vac | 1550 | 1500 | | 5 |
| | Vac | 1550 | 1450 | | 4+ |
| | $H_2$ | 1550-1600 | 1500 | | 4 |
| | | | 1440 | 1350 | 3 |
| A2 | Vac | 1500 | 1500 | | 4 |
| | $H_2$ | 1600 | 1500 | | 5 |
| | Vac | 1550 | 1500 | | 5 |
| | Vac | 1550 | 1450 | | 4+ |
| | Vac | 1550 | 1500 | | 4 |
| | | | 1440 | 1350 | 3 |
| A3 | Vac | 1500 | | 1500 | 4 (poorly bonded) |
| | Vac | 1600 | | 1500 | 4 |

It will be understood that the foregoing description of the preferred embodiments of the present invention is provided for purposes of illustration and description. It is not intended to be exhaustive or to limit the invention to the precise forms disclosed therein. Obviously, many modifications and variations are possible in light of the above teachings. The embodiments were chosen and described in order to best explain the principles of the invention and their practical application will enable others in the art to best utilize the invention and the various embodiments, and with various modifications as are suited to the particular use contemplated, it is intended that the scope of the invention be defined by the claims appended hereto.

What is claimed is:

1. A method for forming a copper-wettable carbided tungsten-yttria inner surface of a laser housing comprising alumina, comprising the steps of applying to the alumina surface to be exposed to copper vapor a coating of a suspension comprising tungsten and yttria in volatilizable solvent; drying said coating; sintering the dried coating at a temperature in the range of about 1500°-1700° C.; carbiding the sintered surface by heating said surface while in contact with a carbon source at a temperature of at least 1400° C.

2. A method for forming a copper-wettable carbided tungsten-yttria inner surface of a laser housing comprising alumina and yttria, comprising the steps of applying to the alumina-yttria surface to be exposed to copper vapor a coating of a suspension comprising tungsten in volatilizable solvent; drying said coating; sintering the dried coating at a temperature in the range of about 1500°-1700° C.; carbiding the sintered surface by heating said surface while in contact with a carbon source at a temperature of at least 1400° C..

3. A method according to claim 1 wherein said suspension contains powdered tungsten and 2% by weight yttria based on the weight of said tungsten.

4. A method according to claim 1 wherein said step of sintering at 1500°-1700° C. is in a vacuum.

5. A method according to claim 1 wherein said step of sintering at 1500°-1700° C. is in an atmosphere of moist hydrogen.

6. A method according to claim 1 wherein said step of carbiding is conducted in the presence of hydrogen.

7. A method according to claim 6 wherein said hydrogen comprises about 5 to 6% by volume in a stream of inert gas.

8. A method according to claim 1 wherein said step of carbiding is conducted by contacting said dried coating with graphite foil.

9. A method according to claim 1 wherein said step of carbiding is conducted by contacting said dried surface with graphite powder.

10. A method for alleviating loss of copper in a copper vapor laser comprising the step of operating said laser such that copper vapor in said laser is in contact with a carbided-tungsten-yttria surface.

11. A method according to claim 2 wherein said step of sintering at 1500°-1700° C. is in a vacuum.

12. A method according to claim 2 wherein said step of sintering at 1500°-1700° C. is in an atmosphere of moist hydrogen.

13. A method according to claim 2 wherein said step of carbiding is conducted in the presence of hydrogen.

14. A method according to claim 2 wherein said step of carbiding is conducted by contacting said dried coating with graphite foil.

15. A method according to claim 2 wherein said step of carbiding is conducted by contacting said dried surface with graphite powder.

* * * * *